US005424628A

United States Patent [19]

Nguyen

[11] Patent Number: 5,424,628

[45] Date of Patent: Jun. 13, 1995

[54] BANDGAP REFERENCE WITH COMPENSATION VIA CURRENT SQUARING

[75] Inventor: Baoson Nguyen, Plano, Tex.

[73] Assignee: Texas Instruments Incorporated, Dallas, Tex.

[21] Appl. No.: 55,605

[22] Filed: Apr. 30, 1993

[51] Int. Cl.[6] ..... G05F 3/16

[52] U.S. Cl. ..... 323/314; 323/907

[58] Field of Search ..... 323/313, 314, 907

[56] References Cited

U.S. PATENT DOCUMENTS

| | | | |
|---|---|---|---|
| 5,087,831 | 2/1992 | Ten Eyck | 323/313 |
| 5,160,882 | 11/1992 | Ten Eyck | 323/314 |
| 5,291,122 | 3/1994 | Audy | 323/313 |
| 5,327,028 | 7/1994 | Yum et al. | 323/313 |
| 5,352,973 | 10/1994 | Audy | 323/313 |

OTHER PUBLICATIONS

A. Paul Brokaw, A Simple Three-Terminal IC Bandgap Reference, *IEEE Journal of Solid-State Circuits*, vol. SC-9, No. 6, Dec. 1974, pp. 388-393.

Klaas Bult and Hans Wallinga, A Class of Analog CMOS Circuits Based on the Square-Law Characteristic of an MOS Transistor in Saturation, *IEEE Journal of Solid-State Circuits*, vol. SC-22, No. 3, Jun. 1987, pp. 357-365.

*Primary Examiner*—Jeffrey L. Sterrett

*Attorney, Agent, or Firm*—W. James Brady, III; Richard L. Donaldson

[57] ABSTRACT

A bandgap reference circuit (14) in a bandgap voltage reference device (10) generates a bandgap voltage reference ($V_{BG}$) at the base of a Q1 transistor (22) and a Q2 transistor (20). A reference current signal $I_T$ flows into the collectors of the Q2 transistor (20) and the Q1 transistor (22) as generated by a difference in base to emitter voltages due to a difference in emitter areas between the Q2 transistor (20) and the Q1 transistor (22). A correction current signal ($I_{TT}$) generated by a current squaring circuit (16) is injected into the collector of the Q1 transistor (22) such that the collectors of the Q2 transistor (20) and the Q1 transistor (22) have unequal current values. The current squaring circuitry (16) generates the correction current signal ($I_{TT}$) by squaring the reference current signal ($I_T$) and dividing it into a sampling current signal ($I_{SC}$) generated in a current generator amplifier (18). The collector current difference between the Q2 transistor (20) and the Q1 transistor (22) enable the elimination of the second order temperature coefficient, as well as the first order temperature coefficient, of the base to emitter voltage ($V_{BE}$) Of the Q1 transistor (22). In this manner, a bandgap voltage reference ($V_{BG}$) becomes more stable, accurate, and less temperature dependent.

18 Claims, 3 Drawing Sheets

BANDGAP REFERENCE WITH COMPENSATION VIA CURRENT SQUARING

TECHNICAL FIELD OF THE INVENTION

This invention relates in general to electronic circuit designs and more particularly to a bandgap voltage reference device and method.

BACKGROUND OF THE INVENTION

Many electronic circuits require a stable and accurate reference voltage for effective operation. However, reference voltages may be unstable due to temperature variations caused during circuit operation. To compensate for the temperature dependence of reference voltages, bandgap circuits were designed to minimize the effect of temperature on the reference voltage. These conventional bandgap circuits only compensate for the first order temperature coefficient of a transistor's base to emitter voltage without completely eliminating the temperature dependent characteristics of the circuit. Thus, the base to emitter voltage remains dependent on changing operating and process characteristics.

SUMMARY OF THE INVENTION

From the foregoing, it may be appreciated that a need has arisen for a bandgap circuit that provides a more stable and accurate reference voltage. A need has also arisen for a bandgap circuit that eliminates the temperature coefficient of a transistor's base to emitter voltage beyond a first order cancellation.

In accordance with the present invention, a device and method are provided which substantially eliminate or reduce disadvantages and problems associated with conventional bandgap circuits.

The present invention includes squaring circuitry for generating a squared current signal from a reference current signal. The squared current signal is applied to reference circuitry in order to generate a bandgap voltage reference.

The device and method of the present invention provide for various technical advantages. For example, one technical advantage is to provide a bandgap circuit that generates a more stable and accurate reference voltage. Another technical advantage is to provide a bandgap circuit that corrects for the second order temperature coefficient of a transistor's base to emitter voltage. Yet another technical advantage is to provide a bandgap circuit that eliminates the temperature dependency of the reference voltage. Still another technical advantage is to provide a bandgap circuit that is independent of changing operating and process characteristics. Other technical advantages are readily apparent to one skilled in the art from the following descriptions, figures, and claims.

BRIEF DESCRIPTION OF THE DRAWINGS

For a more complete understanding of the present invention and the advantages thereof, reference is now made to the following description taken in conjunction with the accompanying drawings, wherein like reference numerals represent like parts, in which.

DETAILED DESCRIPTION OF THE INVENTION

Figure 1:
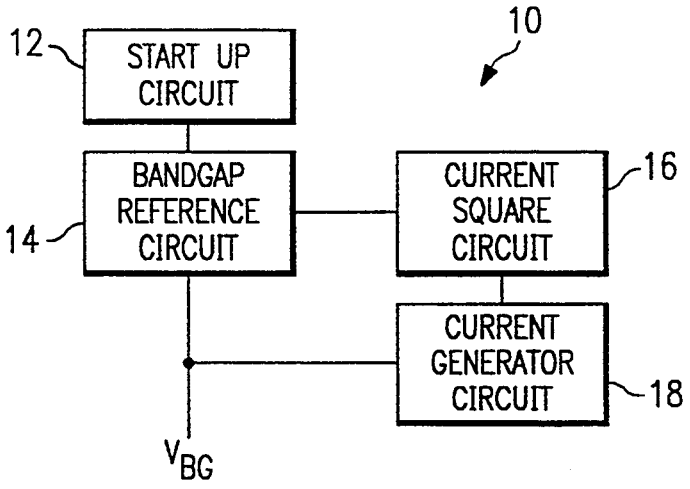
FIG. 1 illustrates a block diagram of a bandgap voltage reference circuit.

FIG. 1 illustrates a block diagram of a bandgap voltage reference device 10. Bandgap voltage reference device 10 includes a start up circuit 12 driving a bandgap reference circuit 14 that generates a bandgap voltage reference $V_{BG}$. Bandgap reference circuit 14 receives a correction current signal $I_{TT}$ from a current squaring circuit 16 that is driven by a current generator amplifier 18. In operation, start up circuit 12 generates the bias and drive currents for bandgap reference circuit 14. Bandgap reference circuit 14 provides current squaring circuit 16 with a reference current signal $I_T$ that is converted into a squared current signal by current squaring circuit 16 and further converted into a correction current signal $I_{TT}$ by a sampling current signal $I_{SC}$ from current generator amplifier 18. The correction current signal is used by reference circuit 14 to generate bandgap voltage reference $V_{BG}$.

Figure 2:
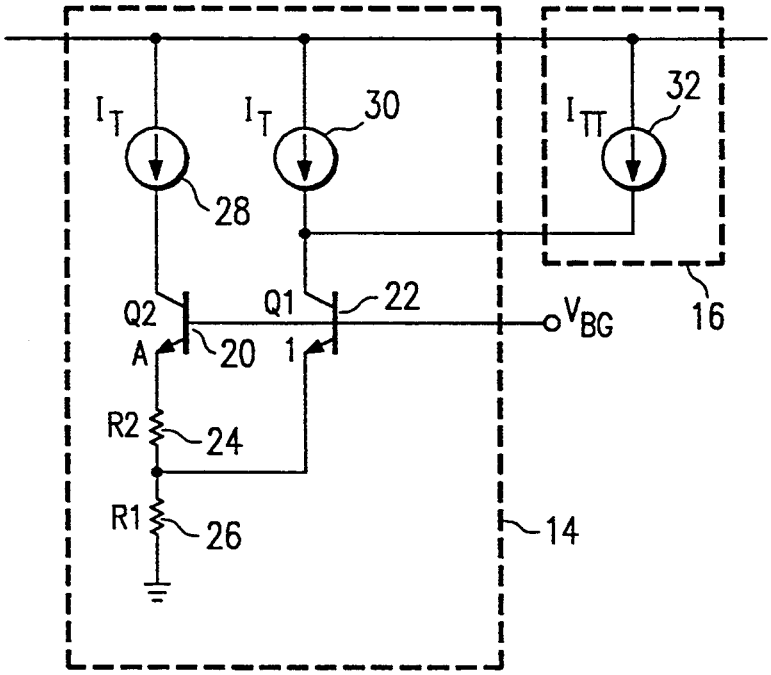
FIG. 2 illustrates a simplified schematic diagram of the bandgap voltage reference circuit; and FIGS. *3a–b* illustrate a schematic diagram of the bandgap voltage reference circuit.

FIG. 2 is a simplified schematic diagram of bandgap voltage reference device 10 showing bandgap reference circuit 14 and current squaring circuit 16. Bandgap reference circuit 14 basically includes transistors 20 and 22, resistors 24 and 26, and $I_T$ reference current signals 28 and 30. Current squaring circuit 16 provides the second order temperature correction through an $I_{TT}$ current correction signal 32. A conventional bandgap circuit is similar to what is shown with respect to bandgap reference circuit 14. The bandgap voltage reference $V_{BG}$ can be expressed by the following equation.

$$V_{BG} \approx \left[ V_{BE1} + K \cdot V_T \cdot \ln\left(\frac{I_{S2}}{I_{S1}}\right)\right] + K \cdot V_T \cdot \ln\left(\frac{I_{C1}}{I_{C2}}\right) \quad (1)$$

where, $V_{BE1}$ is the base to emitter voltage of Q1 transistor 22,

K is a constant, a function of resistors R2 and R1, $V_T$ is a function of a temperature dependent $\Delta$Vbe between transistors Q1 and Q2 generated by an emitter current density ratio at an emitter area ratio between Q2 and Q1 of A:1 (i.e., $V_T \approx B \cdot \Delta Vbe$ and $$I_T \approx \frac{\Delta Vbe}{R_2},$$

B is a function of the ratio of $R_1$ and $R_2$).

$I_{C1}$ is the collector current of transistor Q1, $I_{C2}$ is the collector current of transistor Q2, $I_{S2}$ is the leakage current in transistor Q2, $I_{S1}$ is the leakage current in transistor Q1.

Ideally, $V_T$ has positive temperature coefficients that offset the negative temperature coefficients of $V_{BE1}$ in order to produce a temperature independent bandgap voltage reference $V_{BG}$. However, for conventional bandgap circuits, the third term in Equation (1) above goes to zero since $I_{C1}$ and $I_{C2}$ have the same current value. Since the temperature coefficient of $V_{BE1}$ is not linear, i.e. has first, second, third, and so on, orders, there is no correction for the corresponding order of $V_{BE1}$ due to the cancellation of the third term in Equation (1) above. By bringing in a correction current signal, $I_{TT}$, from current squaring circuit 16, the collector currents at transistors Q1 and Q2 are no longer equal and the third term of Equation (1) above does not cancel out and can be used to offset a corresponding $V_{BE1}$ term. The third term of Equation (1) above can be simplified as follows:

$$K \cdot V_T \cdot \ln\left(\frac{I_{C1}}{I_{C2}}\right) \approx C \cdot T \cdot \ln\left(\frac{D \cdot T + E \cdot T^2}{DT}\right) \approx C \cdot T \cdot \ln(1 + F \cdot T) \quad (2)$$

where $C \cdot T = K \cdot V_T$, expressed as proportional to temperature T, $D \cdot T = I_T$, expressed as proportional to temperature T, $E \cdot T^2 = I_{TT}$, expressed as proportional to the square of temperature T, and F = a constant.

The additional current flowing into the collector transistor Q1 from correction current signal $I_{TT}$ needs to be enough so that the third term of Equation (1) above does not cancel itself out. Therefore, FT will be very small when compared to 1 and Equation (2) above can be further simplified to:

$$C \cdot T \cdot 1n(1 + FT) \approx G \cdot T^2 \quad (3)$$

where G is a constant. The third term of Equation (1) above has now been shown to be reduced to a second order correction to be applied to the second order temperature coefficient of $V_{BE1}$. $V_{BE1}$ can be expressed in its non-linear form and the bandgap voltage reference will become:

$$V_{BG} \approx (e_G - a \cdot T - b \cdot T^2) + (K \cdot V_T \cdot 1nA) + G \cdot T^2 \quad (4)$$

where $e_G$ is the energy gap of silicon, a·T is the first ordered temperature coefficient of $V_{BE1}$, $b \cdot T^2$ is the second order temperature coefficient of $V_{BE1}$, and A is the emitter area ratio proportional to the leakage current ratio.

If the circuit is constructed such that:

$$a \cdot T = K \cdot V_T \cdot 1nA \text{ and } b \cdot T^2 = G \cdot T^2 \quad (5)$$

the bandgap voltage reference just becomes the energy gap of silicon $e_G$ and thus independent of temperature variations. Therefore, by connecting another current signal to the collector of transistor Q1, first and second order temperature corrections are provided to the bandgap voltage reference.

Figure 3A:
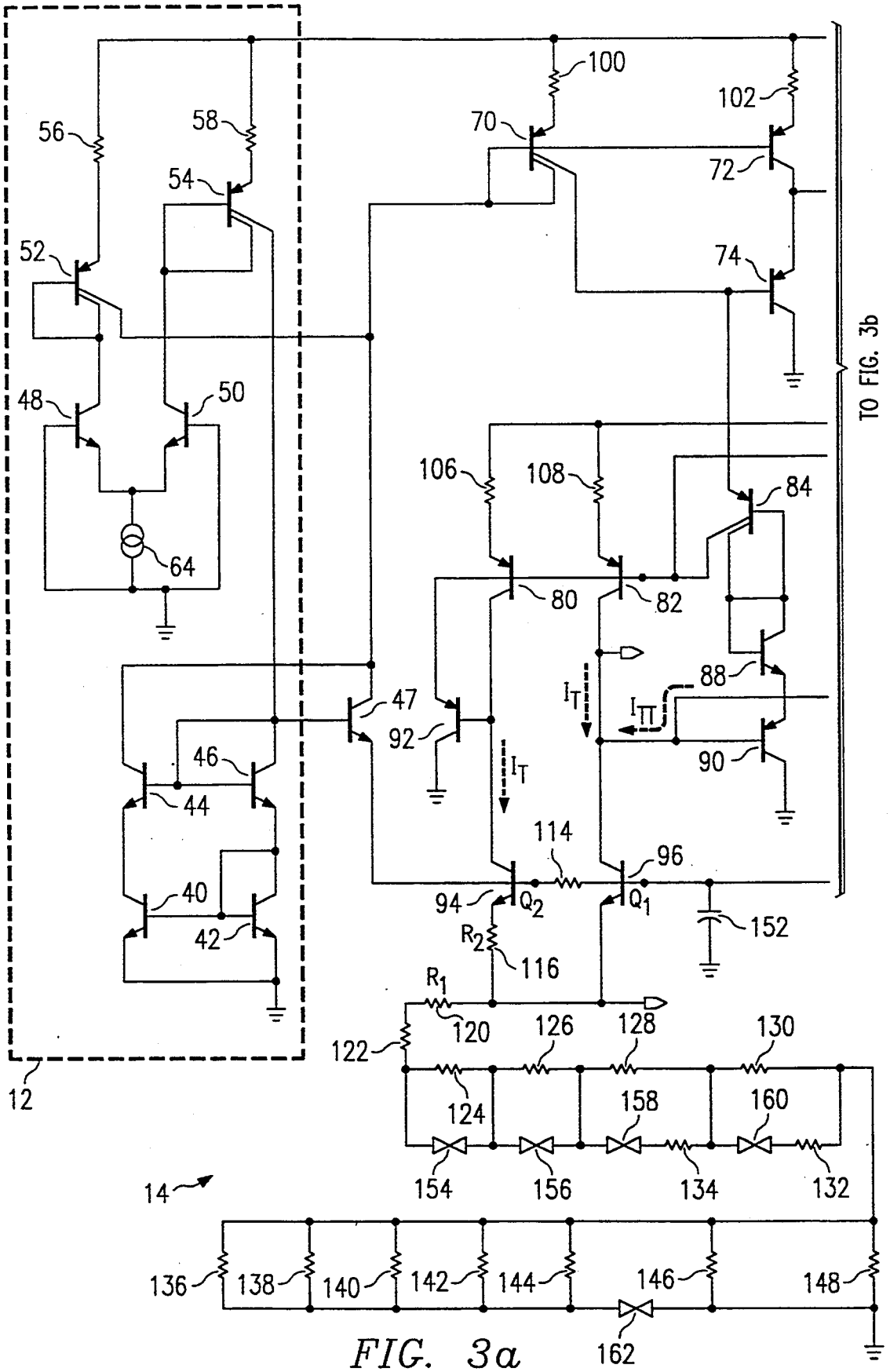
Figure 3B:
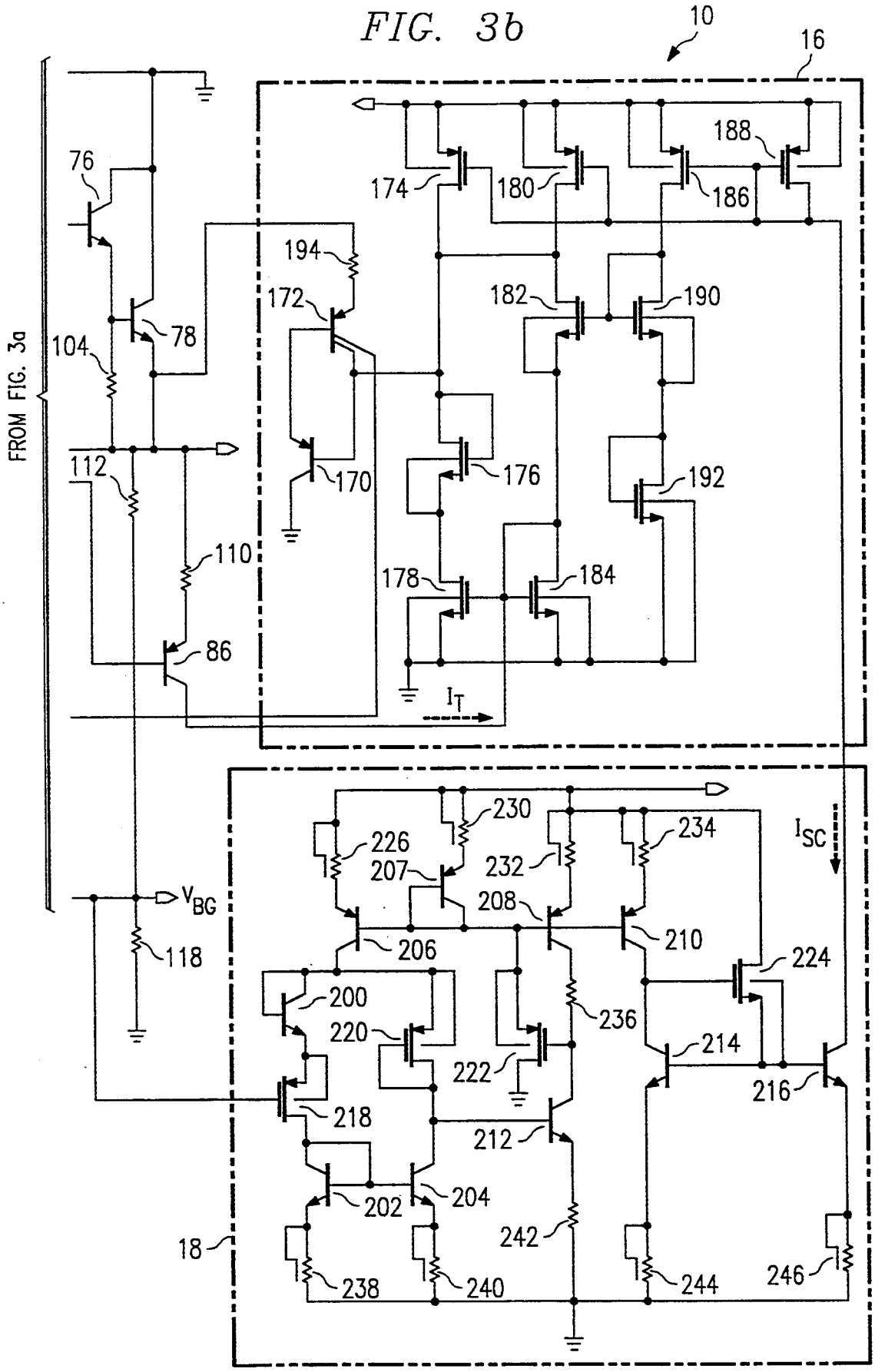

FIG. 3 is a schematic diagram of bandgap voltage reference device 10. Bandgap voltage reference device 10 as shown is implemented with BICMOS transistor technology. Bandgap voltage reference device 10 uses start up circuit 12 having bipolar transistors 40, 42, 44, 46, 48, 50, 52, and 54, resistors 56 and 58, and current source 64. Start up circuit 12 drives bandgap reference circuit 14 having bipolar transistors 70, 72, 74, 76, 78, 80, 82, 84, 86, 88, 90, 92, 94, and 96, resistors 100, 102, 104, 106, 108, 110, 112, 114, 116, 118, 120, 122, 124, 126, 128, 130, 132, 134, 136, 138, 140, 142, 144, 146, and 148, capacitor 152, and zener diodes 154, 156, 158, 160, and 162. Current squaring circuitry 16 includes bipolar transistors 170 and 172, CMOS transistors 174, 176, 178, 180, 182, 184, 186, 188, 190, and 192, and resistor 194. Current generator amplifier 18 includes bipolar transistors 200, 202, 204, 206, 207, 208, 210, 212, 214, and 216, CMOS transistors 218, 220, 222, and 224, and resistors 230, 232, 234, 236, 238, 240, 242, 244, and 246.

In bandgap reference circuit 14, reference current signal $I_T$ flows into the collectors of Q2 transistor 94 and Q1 transistor 96 from current mirror transistors 80 and 82, respectively, as generated by the $\Delta V_{BE}$ between Q2 transistor 94 and Q1 transistor 96. Current squaring circuit 16 also receives reference current signal $I_T$ from current mirror transistor 86. Current squaring circuit 16 further receives a sampling current signal $I_{SC}$ generated by current generator amplifier 18 at transistor 216 that is independent of temperature.

Bandgap voltage reference device 10 takes advantage of the square law behavior for the current-voltage relationship of CMOS transistors in the saturation region. Current squaring circuit 16 squares reference current signal $I_T$ from bandgap reference circuit 14 and combines it with sampling current signal $I_{SC}$ from current generator amplifier 18 to produce correction current signal $I_{TT}$ as represented by the equation $$I_{TT} \approx \frac{I_T^2}{8I_{SC}}.$$

Current generator amplifier 18 receives bandgap voltage reference $V_{BG}$ at the base of CMOS transistor 218 to generate sampling current signal $I_{SC}$ which can be expressed as $$I_{SC} \approx \frac{V_{BG}}{R_3},$$

illustrating the temperature independence of sampling current signal $I_{SC}$.

Correction current signal $I_{TT}$ from current squaring circuit 16 is combined with reference current signal $I_T$ at the collector of Q1 transistor 96 so that the collector currents of Q1 transistor 96 and Q2 transistor 94 are of unequal value. With the collector currents of Q1 transistor 96 and Q2 transistor 94 at unequal values, the second order parameter represented by the third term of Equation (1) above does not cancel itself out and can be applied to the second order parameter of the base to emitter voltage $V_{BE1}$ of Q1 transistor 96. In this manner, first and second order temperature coefficients of $V_{BE1}$ are eliminated, thus improving the stability and accuracy of bandgap voltage reference $V_{BG}$.

Start up circuit 12 ensures that bandgap reference circuit 14 is driven to an appropriate voltage level. The resistor network connected to R1 resistor 140 provides desired trimming levels to bandgap reference circuit 14. Zener diodes 154, 156, 158, 160, and 162 act as fuse links for the resister network.

In summary, a bandgap voltage reference device improves the stability and accuracy of a bandgap voltage reference by eliminating not only the first order temperature coefficient of the first bandgap transistor's base to emitter voltage as done in conventional bandgap circuits, but also eliminates the second order temperature coefficient of the first bandgap transistor's base to emitter voltage. The elimination of the second order temperature coefficient is accomplished by injecting a correction current signal into the collector of the first bandgap transistor. This correction current signal is a function of a reference current signal generated at the collector of the first and second bandgap transistors by a difference in base to emitter voltages due to a difference in emitter areas between the first and second bandgap transistors. A current squaring circuit enhances the reference current signal by a power of 2 and divides it by a sampling current signal to produce the correction current signal injected into the collector of the bandgap transistor.

Thus, it is apparent that there has been provided, in accordance with the present invention, a method and device for improving the stability of a bandgap voltage reference that satisfies the advantages set forth above. Although the preferred embodiment has been described in detail, it should be understood that various changes, substitutions, and alterations can be made herein. For example, many of the direct connections illustrated herein can be altered by one skilled in the art such that two devices are merely coupled to one another through an intermediate device or devices without being directly connected as illustrated in the preferred embodiment. Also, one skilled in the art may appreciate that the present invention may be implemented in transistor technologies other than the disclosed BICMOS technology. These and other examples are readily ascertainable by one skilled in the art and could be made without departing from the spirit and scope of the present invention as defined by the following claims.

What is claimed is:

1. A bandgap voltage reference device, comprising:

current squaring circuitry for generating a correction current signal in response to a reference current signal; and bandgap reference circuitry for generating a bandgap voltage reference in response to said correction current signal.

2. The device of claim 1, wherein said bandgap reference circuitry generates said reference current signal.

3. The device of claim 1, wherein said current squaring circuitry converts said reference current signal into a squared current signal in order to generate said correction current signal.

4. The device of claim 3, further comprising:

current generator amplifying circuitry for generating an sampled current signal, said sampled current signal being combined with said squared current signal to produce said correction current signal.

5. The device of claim 1, further comprising:

start up circuitry for driving said bandgap reference circuitry.

6. A bandgap voltage reference device, comprising:

a current squaring circuit for receiving a reference current signal and generating a correction current signal in response to said reference current signal;

a bandgap reference circuit for generating a first and second order temperature corrected bandgap voltage reference in response to said correction current signal.

7. The device of claim 6, wherein said bandgap reference circuit generates said reference current signal.

8. The device of claim 6, wherein said current squaring circuit converts said reference current signal into a squared current signal, said squared current signal being a power of two greater than said reference current signal.

9. The device of claim 6, further comprising:

a current generator amplifier for generating a sampled current signal in response to said bandgap voltage reference.

10. The device of claim 9, wherein said current squaring circuit combines said sampled current signal with a square of said reference current signal to produce said correction current signal.

11. The device of claim 6, wherein said bandgap reference circuit includes a first transistor and a second transistor, said reference current signal flowing into a collector of said first transistor and a collector of said second transistor, said correction current signal flowing into said collector of said first transistor, said bandgap voltage reference produced at a base of said first transistor and a base of said second transistor.

12. The device of claim 11, wherein said bandgap reference circuit eliminates first and second order temperature coefficients of a base to emitter voltage of said first transistor at said bandgap voltage reference in response to said correction current signal.

13. The device of claim 6, wherein said current squaring circuit includes CMOS transistors.

14. The device of claim 6, further comprising:

a start up circuit for providing current drive to said bandgap reference circuit.

15. A method of generating a bandgap voltage reference, comprising the steps of:

generating a reference current signal;

squaring said reference current signal to produce a squared current signal;

converting said squared current signal into a correction current signal;

applying said correction current signal to eliminate first and second order temperature coefficients of a bandgap voltage reference.

16. The method of claim 15, further comprising the step of:

generating an amplified current signal in response to said bandgap voltage reference.

17. The method of claim 16, wherein said applying step includes combining said squared current signal with said amplified current signal to produce said correction current signal.

18. The method of claim 17, further comprising the step of:

correcting said bandgap voltage reference in response to said correction current signal.

* * * * *